United States Patent [19]

Marschak

[11] 4,344,540

[45] Aug. 17, 1982

[54] DISPLAY DEVICE

[76] Inventor: Howard J. Marschak, 865 W. North Ave., Chicago, Ill. 60622

[21] Appl. No.: 222,302

[22] Filed: Jan. 5, 1981

[51] Int. Cl.[3] ..... A47F 5/01

[52] U.S. Cl. ..... 211/106; 211/591.1; 211/87; 248/220.3

[58] Field of Search ..... 211/106, 57.1, 59.1, 211/60 R, 60 T, 87, 181, 123, 105.1, 54.1; 248/220.3, 220.4, 221.1, 221.2

[56] References Cited

U.S. PATENT DOCUMENTS 3,486,632 12/1969 Balch ..... 211/87 X
3,976,201 8/1976 Hodgson et al. ..... 248/220.4

FOREIGN PATENT DOCUMENTS 963877 3/1975 Canada ..... 248/221.1

*Primary Examiner*—Roy D. Frazier
*Assistant Examiner*—Robert W. Gibson, Jr.
*Attorney, Agent, or Firm*—Dithmar, Stotland, Stratman & Levy

[57] ABSTRACT

A display unit used with an apertured support for displaying a plurality of elongated objects such as fan belts comprising a plurality of open-ended vertically spaced-apart sleeves each connected to the apertured support by two brackets. Each of the brackets is a one-piece wire having two free ends thereof formed into vertically spaced-apart engagement prongs for extending through apertures in the apertured support, the end of the bracket away from the prongs being a closed end constructed to support a sleeve thereon and lying in a plane parallel to the apertured support when the bracket is mounted thereon. The closed end of the bracket is connected to the engagement prongs by two legs respectively extending therebetween, each of the legs having a bracing portion thereof parallel to the closed end and proximate the apertured support when the bracket is mounted for use. Each of the tubular sleeves is constructed and arranged to receive within the open ends thereof the closed end portion of facing brackets to be supported thereby and to position the sleeves at various distances from the apertured support for retaining and displaying a plurality of elongated objects.

14 Claims, 4 Drawing Figures

DISPLAY DEVICE

BACKGROUND OF THE INVENTION

Display units used to display and illustrate merchandise must be inexpensive, yet of relatively sturdy construction in order that a great many of the displayed units can be used while at the same time withstanding severe abuse so that the displayed commodities are retained in a predetermined spaced displayed relationship. An additional requirement for display devices is that they have a capacity sufficiently large to permit sufficient numbers of the commodities to be shown at one time so that the store management does not continually replenish the supply of its displayed articles. Stocking and restocking problems are alleviated by having a large capacity display device, but the display device must be sufficiently spaceous to accommodate the merchandise in the manner readily visible to the potential purchaser. This is a problem where the merchandise to be displayed is large. Particularly, displays of automotive merchandise including such items as fan belts and the like present a real problem for the merchandiser.

BRIEF SUMMARY OF THE INVENTION

This invention relates to a display device or unit in which a plurality of elongated articles may be displayed by positioning the articles at different distances from the apertured support.

A principal object of the present invention is to provide a display unit used with an apertured support for displaying a plurality of elongated objects, comprising a plurality of open-ended vertically spaced apart sleeves each connected to the apertured support by two brackets. Each of the brackets being a one-piece construction member having two engagement prongs for insertion into the apertured support to maintain the brackets thereon, each of the brackets when mounted on the support having a bracing portion thereof extending parallel to and proximate the apertured support and having a closed end portion parallel to the bracing portion and spaced therefrom and from the support, and a leg portion interconnecting the bracing portion and the closed end portion, each of the tubular sleeves being constructed and arranged to receive within the open ends thereof the closed end portion of facing brackets to be supported thereby and to position the sleeves for retaining and displaying a plurality of elongated objects.

Still another object of the present invention is to provide a bracket for use with an apertured support, comprising a one-piece wire having two free ends thereof formed into vertically spaced-apart engagement prongs for extending through apertures in the apertured support, the end of the bracket away from the prongs being a closed end constructed to support a sleeve thereon and lying in a plane parallel to the apertured support when the bracket is mounted thereon, the closed end being connected to the engagement prongs by two legs respectively extending therebetween, each of the legs having a bracing portion thereof parallel to the closed end and proximate the apertured support when the bracket is mounted for use.

These and other objects of the present invention together with the operation thereof may be more readily understood when taken in conjunction with the following specification and drawings, in which:

DESCRIPTION OF THE PREFERRED EMBODIMENT

Figures 1, 2, 3, 4:
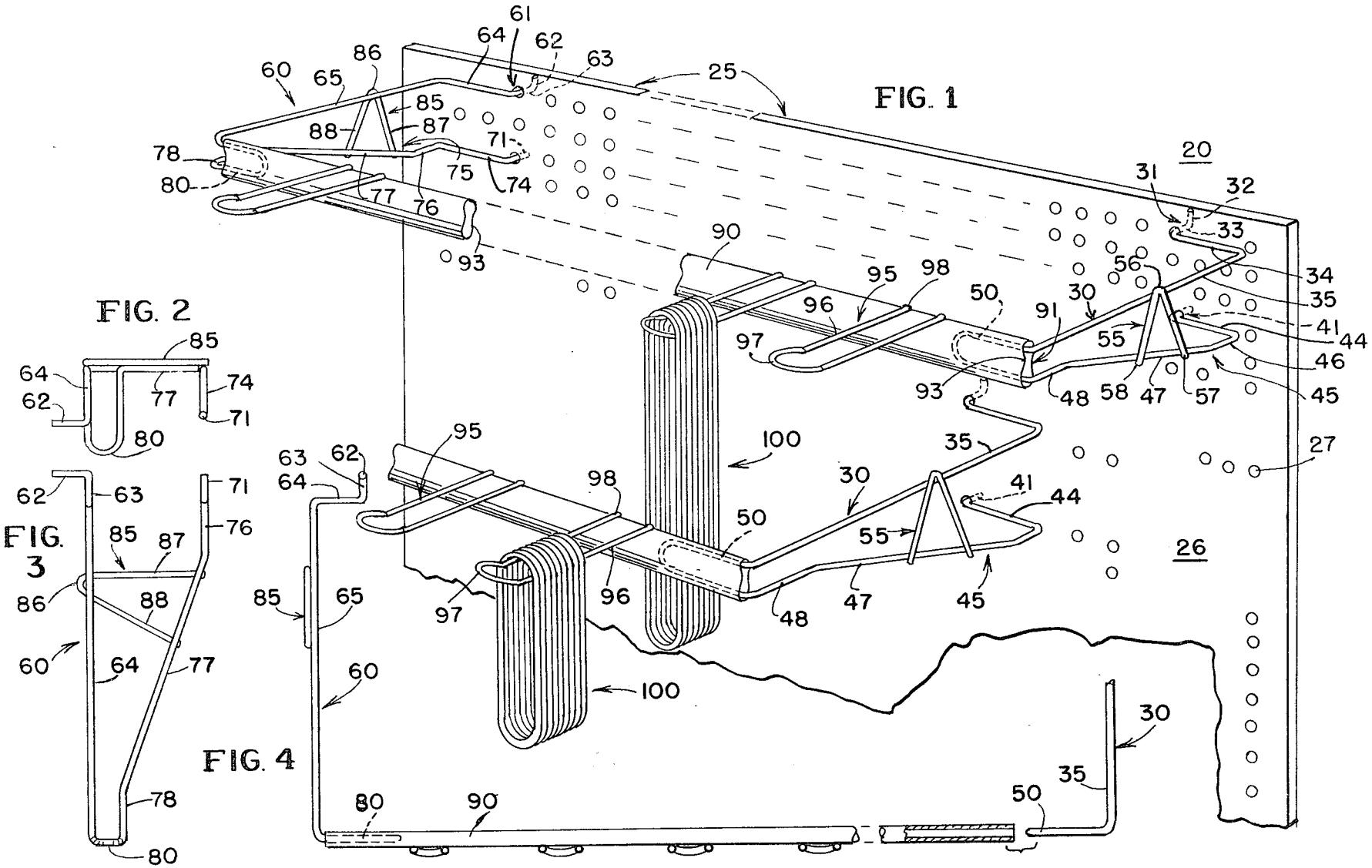
FIG. 1 is a perspective view of the display unit or device of the present invention shown mounted to an associated apertured support and having a plurality of vertically spaced apart sleeves for holding the merchandise to be displayed.
FIG. 2 is a rear elevational view of the left-hand bracket illustrated in FIG. 1 rotated through 90°.
FIG. 3 is an elevational view of the left-hand bracket illustrated in FIG. 1 as viewed from the right-hand side thereof.
FIG. 4 is a top elevational view of the uppermost sleeve and support brackets thereof illustrated in FIG. 1.

Referring now to the drawings there is shown a display unit 20 including an apertured support 25, more commonly referred to as a peg board, which has a substantially flat front surface 26 and a plurality of apertures 27 arranged in columns and rows. Brackets 30 and 60 are combined with sleeves 90 to provide an article display device or unit. The right-hand bracket 30 is a one-piece wire bent to form an engagement prong 31 having an upstanding portion 32 generally parallel to the plane of the apertured support 25 and a portion 33 which is perpendicular to the plane of the support 25 and is adapted to pass through a selected one of the apertures 27 therein. The right-hand bracket 30 further includes a bracing portion 34 which is straight and extends parallel to and is proximate and may contact the front surface 26 of the apertured support 25. Integrally connected to the bracing portion 34 is a front leg portion 35 extending perpendicularly to the plane of the apertured support 25 in a straight flight.

The right-hand bracket 30 is further provided with an engagement prong 41 perpendicular to the plane of the apertured support 25 and constructed and arranged to pass through an aperture 27 therein. Integral with the engagement prong 41 is a bracing portion 44 which is parallel to and proximate the plane of the apertured support 25 and may contact the front surface 26 thereof, the bracing portion 44 being vertically spaced downwardly in use from the bracing portion 34 of the bracket 30. Extending integrally outwardly from the bracing portion 44 of the right-hand bracket 30 is a leg portion 45 having a perpendicular part 46 extending outwardly and perpendicularly to the bracing portion 44 and an upwardly slanting portion 47 extending to a portion 48 which is parallel to the leg 35. Both the leg 35 and the leg 45 terminate in a closed end portion 50 which is arranged at an angle of about 100° to the legs 35 and 45 to provide rigidity to the construction and substantially parallel to the respective bracing portions 34 and 44 thereof and in use substantially parallel to the plane of the apertured support 25. A brace 55 is positioned across the legs 35 and 45 and includes a leg 57 which is perpendicular to the leg 35 and a leg 58 which intersects the leg 55 in an angle other than 90°, the two legs 57 and 58 being interconnected by a bend 56.

The left-hand bracket 60 is a mirror image of the right-hand bracket 30 and includes a one-piece wire bent to form an engagement prong 61 having an upstanding portion 62 generally parallel to the plane of the apertured support 25 and a portion 63 which is perpendicular to the plane of the support 25 and is adapted to pass through a selected one of the apertures 27 therein. The left-hand bracket 60 further includes a bracing portion 64 which is straight and extends parallel to and is proximate and may contact the front surface 26 of the apertured support 25. Integrally connected to the bracing portion 64 is a front leg portion 65 extending perpendicularly to the plane of the apertured support 25 in a straight flight.

The left-hand bracket is further provided with an engagement prong 71 perpendicular to the plane of the apertured support 25 and constructed and arranged to pass through an aperture therein. Integral with the engagement prong 71 is a bracing portion 74 which is parallel to and proximate the plane of the apertured support 25 and may contact the front surface 26 thereof, the bracing portion 77 being vertically spaced downwardly in use from the bracing portion 64 of the bracket 60. Extending integrally outwardly from the bracing portion 74 of the left-hand bracket 60 is a leg portion 75 having a perpendicular part 76 extending outwardly and perpendicularly to the bracing portion 74 and an upstanding slanting portion 77 extending to a portion 78 which is parallel to the legs 65. Both the legs 65 and 75 terminate in a closed end position 80 which is arranged generally perpendicular to the legs 65 and 75 and parallel to the respective bracing portions 64 and 74 thereof and in use parallel to the plane of the apertured support 25. A brace 85 is positioned across the legs 65 and 75 and includes a leg 87 which is perpendicular to the leg 65 and a leg 88 which intersects the leg 85 in an angle other than 90°, the two legs 87 and 88 being interconnected by a bend 86.

A pair of brackets 30, 60 is used to support a sleeve 90 having open ends 91 with a crimped middle 93 on the apertured support 25. Extending generally perpendicularly outwardly from the sleeve 90 are a plurality of spaced apart article supports 95, each provided with two legs 96 connected by a closed end 97 which is angled upwardly out of the plane formed by the two legs 96, the legs 96 being connected to the sleeve 90 at the attachment ends 98 of the legs. The number of article supports 95 connected to the sleeve 90 is a matter of choice and design, with each of the article supports being constructed and arranged to accommodate a plurality of articles 100 such as radiator belts or other elongated objects, the weight of which will cause the bracing portions 34, 44 of bracket 30 and 64, 74 of bracket 60, to contact the surface 26 of the support firmly to lock the unit in place and prevent inadvertent dislodgement thereof.

The display unit 20 is provided with a plurality of merchandise display mechanisms each including a pair of brackets 30, 60 supporting a sleeve 90 having article supports 95 extending therefrom, each of the sleeves 90 being positioned at a different distance from the surface 26 of the apertured support 25, thereby to permit elongated articles 100 to be displayed from a plurality of merchandise display mechanisms located at different positions on the apertured support 25.

While there has been described what at present is considered to be the preferred embodiment of the present invention, it will be understood that various modifications and alterations may be made therein without departing from the true spirit and scope of the present invention, and it is intended to cover in the appended claims all such modifications and alterations.

What is claimed is:

1. A display unit used with an apertured support for displaying a plurality of elongated objects, comprising a plurality of open-ended vertically spaced-apart sleeves each connected to the apertured support by two brackets, each of said brackets being a one-piece member having two engagement prongs for insertion into the apertured support to maintain said brackets thereon, each of said brackets when mounted on the support having a bracing portion thereof extending parallel to and proximate the apertured support and having a closed end portion parallel to said bracing portion and spaced therefrom and from the support, and a leg portion interconnecting said bracing portion and said closed end portion, each of said tubular sleeves being constructed and arranged to receive within said open ends thereof the closed end portion of facing brackets to be supported thereby and to position said sleeves for retaining and displaying a plurality of elongated objects.

2. The display unit of claim 1, wherein said sleeves are cylindrical.

3. The display unit of claim 2, wherein said cylindrical sleeves are oval in transverse cross-section with the middle portion of the sleeves being pinched together longitudinally of said sleeve.

4. The display unit of claim 1, wherein at least some of said sleeves are spaced a different distance perpendicular to the apertured support than other of said sleeves, thereby to permit elongated objects to be hung on said sleeves.

5. The display unit of claim 1, wherein one of said engagement prongs is perpendicular to the plane of the apertured support when inserted therein and the other engagement prong has a portion thereof extending through an aperture in the apertured support and a portion thereof parallel to the apertured support.

6. The display unit of claim 1, wherein said leg portion includes two vertically spaced apart flights.

7. The display unit of claim 6, wherein said flights are connected by a support strut welded thereto.

8. The display unit of claim 1, and further comprising a plurality of outwardly extending support members mounted on at least some of said sleeves.

9. The display unit of claim 8, wherein said outwardly extending support members are a pair of parallel legs closed at the far end, the closed end being upwardly angled out of the plane of the parallel legs.

10. A bracket for use with an apertured support, comprising a one-piece wire having two free ends thereof formed into vertically spaced-apart engagement prongs for extending through apertures in the apertured support, the end of said bracket away from said prongs being a closed end constructed to support a sleeve thereon and lying in a plane parallel to the apertured support when said bracket is mounted thereon, the closed end being connected to said engagement prongs by two legs respectively extending therebetween, each of said legs having a bracing portion thereof parallel to said closed end and proximate the apertured support when said bracket is mounted for use.

11. The display unit of claim 10, wherein one of said engagement prongs is perpendicular to the plane of the apertured support when inserted therein and the other engagement prong has a portion thereof extending through an aperture in the apertured support and a portion thereof parallel to the apertured support.

12. The display unit of claim 10, wherein said leg portion includes two vertically spaced apart flights.

13. The bracket of claim 10, wherein the bracing portion is perpendicular to the part of the associated engagement prong constructed to extend through the apertured support.

14. The bracket of claim 10, wherein the two legs are spaced farther apart near the engagement prongs and closer together near the closed end.

* * * * *